US006682259B1

(12) United States Patent
Thomas, Sr. et al.

(10) Patent No.: US 6,682,259 B1
(45) Date of Patent: Jan. 27, 2004

(54) STRUCTURE HAVING AN INSULATED SUPPORT ASSEMBLY

(75) Inventors: Rupert R. Thomas, Sr., Edmond, OK (US); John Pannell, Midwest City, OK (US)

(73) Assignee: Earthsource Technologies, Midwest City, OK (US)

( * ) Notice: Subject to any disclaimer, the term of this patent is extended or adjusted under 35 U.S.C. 154(b) by 0 days.

(21) Appl. No.: 10/163,271

(22) Filed: May 24, 2002

Related U.S. Application Data

(63) Continuation of application No. 09/498,431, filed on Feb. 4, 2000, now abandoned.

(51) Int. Cl.[7] ..... E01D 4/00
(52) U.S. Cl. ..... 404/71; 14/24; 14/26
(58) Field of Search ..... 14/24, 25, 26; 404/71, 77, 79; 52/86, 88; 405/125

(56) References Cited

U.S. PATENT DOCUMENTS

| | | | | |
|---|---|---|---|---|
| 625,258 | A | 5/1899 | Grow | |
| 795,772 | A | 7/1905 | Janney | |
| 852,971 | A | 5/1907 | Luten | 14/26 |
| 2,822,765 | A | 2/1958 | Rudinger | 109/1 |
| 3,092,933 | A | 6/1963 | Closner et al. | 50/129 |
| 3,227,061 | A | 1/1966 | Swayze | 98/1 |
| 3,597,890 | A | 8/1971 | Hala | 52/86 |
| 3,701,262 | A | 10/1972 | Connell et al. | 62/45 |
| 3,707,850 | A | 1/1973 | Connell et al. | 62/45 |
| 3,906,067 | A | 9/1975 | Alspach | 264/46.5 |
| 4,232,489 | A | 11/1980 | Corvington et al. | 52/63 |
| 4,305,681 | A * | 12/1981 | Backlund | 404/95 |
| 4,321,775 | A | 3/1982 | Emerson | 52/66 |
| 4,359,845 | A * | 11/1982 | Harrison | 52/169.6 |
| 4,488,392 | A | 12/1984 | Pearcey et al. | 52/742 |
| 4,534,144 | A | 8/1985 | Gustafsson et al. | 52/169.6 |
| 4,587,684 | A | 5/1986 | Miller | 14/24 |
| 4,631,872 | A | 12/1986 | Daroga | 52/1 |
| 4,642,952 | A | 2/1987 | Prandin | 52/169.6 |
| 4,693,300 | A | 9/1987 | Adachi | 165/1 |
| 4,907,383 | A | 3/1990 | Winter, IV | 52/86 |
| 5,024,553 | A | 6/1991 | Katsuragi | 404/71 |
| 5,344,362 | A | 9/1994 | Bagley | 454/180 |
| 5,380,123 | A * | 1/1995 | Ryynanen | 404/82 |
| 5,393,173 | A | 2/1995 | Morello | 405/258 |
| 5,395,179 | A | 3/1995 | Kotani | 404/71 |
| 5,488,375 | A * | 1/1996 | Michie | 342/26 |
| 5,549,418 | A | 8/1996 | Devine et al. | 405/258 |
| 5,655,347 | A | 8/1997 | Mahieu | 52/639 |
| 5,815,989 | A * | 10/1998 | Bennenk et al. | 52/80.1 |

FOREIGN PATENT DOCUMENTS

| | | | | |
|---|---|---|---|---|
| DK | WO 91/02847 | * | 3/1991 | E01D/19/08 |

* cited by examiner

*Primary Examiner*—Robert E. Pezzuto
*Assistant Examiner*—Raymond Addie
(74) *Attorney, Agent, or Firm*—Dunlap, Codding & Rogers, P.C.

(57) ABSTRACT

A structure for supporting a road along a road axis over an underpass space spanned by the structure. The structure includes two footings underlying the road with each support assembly being securely mounted to the earth. The structure also includes an arcuate support assembly supported by the footings. The support assembly extends at least the width of the road and traverses the underpass space for supporting the road across the underpass space spanned by the structure. The support assembly includes a substantially continuous inner shell, a plurality of spatially disposed, rigid, resilient beams supported by the footings, an insulating material disposed in the cavities formed in between the rigid, resilient beams, and an outer shell encasing the rigid, resilient beams and the insulating material. A substantially fluid impermeable material substantially encases the support assembly and a fill material extends from the substantially fluid impermeable material to support the road.

19 Claims, 5 Drawing Sheets

STRUCTURE HAVING AN INSULATED SUPPORT ASSEMBLY

CROSS REFERENCED TO RELATED APPLICATIONS

This application is a continuation of U.S. Ser. No. 09/498,431, filed on Feb. 4, 2000 now abandoned, the entire content of which is hereby incorporated herein by reference.

FEDERALLY SPONSORED RESEARCH AND DEVELOPMENT

Not Applicable.

BACKGROUND OF THE INVENTION

Climatic influences, such as heat and cold, cause steel, concrete and other elements of bridges, whether highway, railway, or recreational, for example, to expand and contract in varying increments over time. By such movement, the integrity of the bridge can be eroded and ultimately destroyed. In particular, the more extreme freeze/thaw cycles reduce the strength of the bridge, and the bridge must therefore be constructed with more strength than would otherwise be necessary. In response to these problems, the federal government is currently funding research for extending the longevity of bridges.

In addition, during inclement cold weather, bridges and underpasses tend to ice over more quickly than the roadways leading to and from the bridges and underpasses. It is well recognized in the art that intermittent freezing and thawing greatly increase the hazards of winter driving. Most of the accidents result from the fact that the paving on the bridges and underpasses become coated with frost, ice or snow sooner and more often than the approaching pavements which result in the unwary driver frequently skidding upon entering the bridge or underpass.

It would represent an advance in the state of the art to provide a structure, such as a bridge or a culvert, which did not suffer from the aforementioned problems of the movement of the bridges, and the bridges and underpasses becoming coated with frost, ice or snow sooner and more often than their approach pavements. It is to such a unique structure having an insulated support assembly that the present invention is directed.

SUMMARY OF THE INVENTION

Broadly, the present invention relates to a structure, which in one preferred embodiment can be utilized as a bridge for supporting a road along a road axis over an underpass space spanned by the bridge or in a second preferred embodiment can form a culvert. In the one preferred embodiment, the road has a predetermined width extending in a direction transverse to the road axis. The structure includes two footings underlying the road with each footing being securely mounted to the earth. The footings are spaced apart in a direction substantially parallel to the road axis.

The structure also includes an arcuate support assembly supported by the footings. The support assembly extends at least the width of the road and traverses the underpass space for supporting the road across the underpass space spanned by the structure. The support assembly includes a substantially continuous inner shell, a plurality of rigid, resilient beams, an insulating material, and an outer shell.

The substantially continuous inner shell has a width at least corresponding to the road. The inner shell extends between the two footings so as to define the underpass space spanned by the structure.

The rigid, resilient beams surmount the inner shell. Each beam has a first end supported by one of the footings, and a second end supported by the other footing. The beams are spatially disposed in a direction transverse to the road axis and have a longitudinal axis extending in a direction substantially parallel to the road axis.

The insulating material is positioned between each of the beams for thermally isolating the road and the remainder of the support assembly from the underpass space and substantially preventing the transfer of heat there through.

The outer shell has a first end supported by one of the footings, and a second end supported by the other footing. The outer shell substantially encases the beams and the insulating material.

The substantially fluid impermeable material substantially encases the support assembly and a fill material extends from the substantially fluid impermeable material to support the road.

The support assembly also includes a pair of sidewalls extending parallel to the road axis on either side of the support assembly. The sidewalls are provided with an inner insulating layer to prevent heat from migrating through the sidewalls.

Thus, it can be seen that the insulating material provided between the beams and in the sidewall substantially prevent the fill material, and thus the road supported thereby, from losing heat through the sidewalls and the support assembly. Furthermore, the fill material acts as an insulator to insulate the support assembly. This stabilizes the temperature of the structure so as to prevent or reduce the aforementioned problems associated with the expansion and contraction of the structure, and the icing over of the road supported thereby.

In the colder geographic regions where there are extended periods of below freezing weather, a heat exchange assembly can be disposed throughout the fill material, the roadbed or the road extending through the underpass to selectively maintain the temperature of the fill material, the roadbed or the road extending through the underpass within a predetermined range so as to reduce the possibility of the road supported by the structure or passing through the underpass from icing over. A temperature control source is connected to the heat exchange assembly for providing a source of heat to the heat exchange assembly for controlling the temperature of the fill material, the roadbed, or the road passing through the underpass. The temperature control source is controlled by an environmental control computer which receives information from 1) various temperature sensors disposed in the roadbed, the fill material, or the road passing through the underpass, 2) a wind sensor located near the structure, or 3) a weather information receiver receiving information from any suitable source of weather forecasts, such as the National Weather Service. The environmental control computer receives the various information discussed above, and selectively controls the temperature control source to control the temperature of the road passing over the structure, the fill material and thus, the temperature of the support assembly, and the road passing through the underpass defined by the structure so that the expansion and contraction of the support assembly, and the icing over of the road passing over the structure, and the road passing through the underpass space are substantially reduced.

Thus, it can be seen that the applicants' unique structure represents an advance in the state-of-the-art relating to structures and bridge support assemblies.

BRIEF DESCRIPTION OF THE SEVERAL VIEW OF THE DRAWINGS

FIG. 8 is a sectional view of a fifth embodiment of a structure constructed in accordance with the present invention.

DETAILED DESCRIPTION OF THE INVENTION

Figure 1:
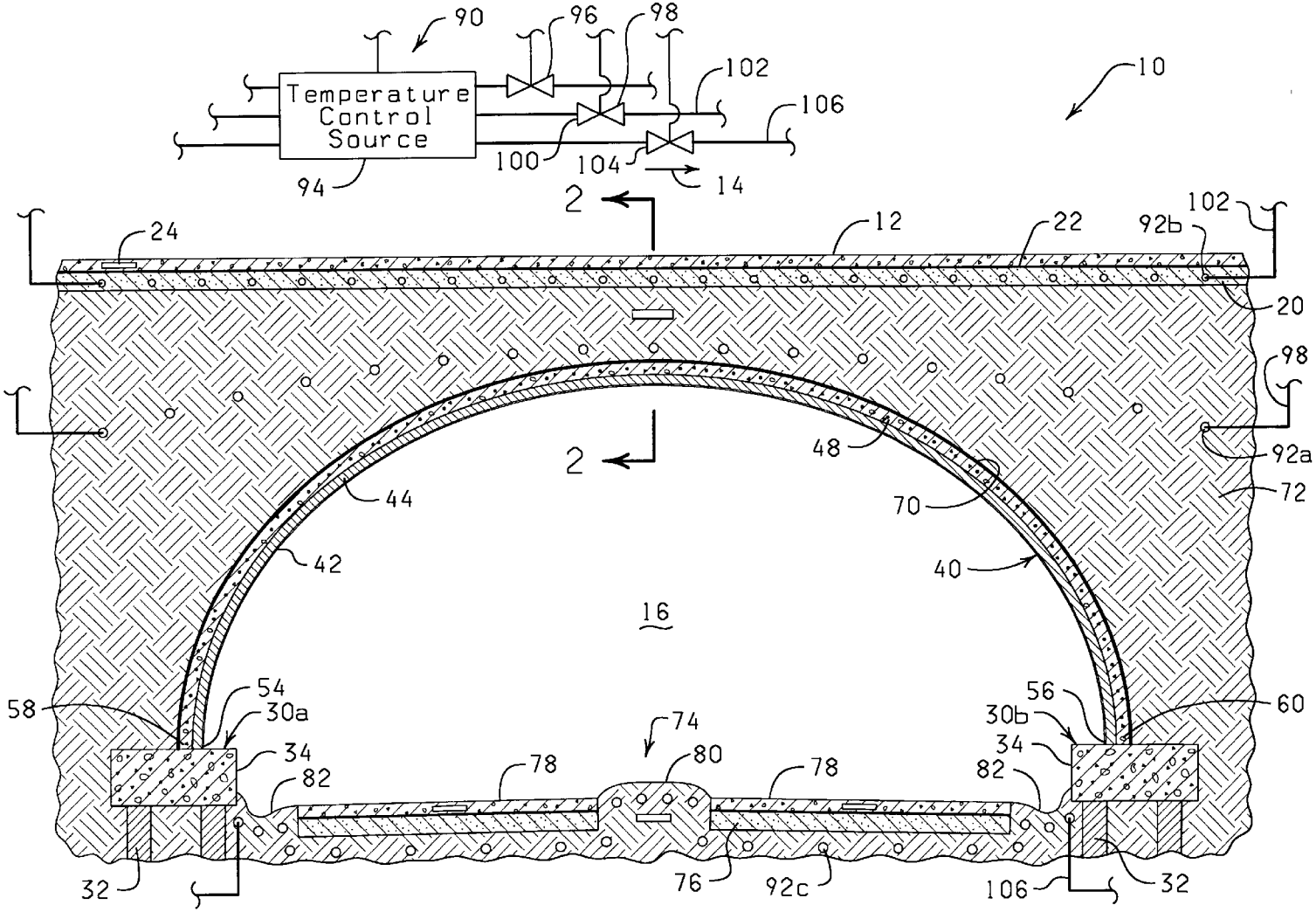
FIG. 1 is sectional view of a structure constructed in accordance with the present invention.

Referring to the drawings and in particular to FIG. 1, shown therein and designated by the general reference numeral 10 is a structure constructed in accordance with the present invention. The structure 10 supports a road 12 along a road axis 14 over an underpass space 16 spanned by the structure 10. The road 12 has a predetermined width (not shown) extending in a direction 18 (FIG. 2) transverse to the road axis 14.

The road 12 is supported on a roadbed 20 in a well-known manner. A fabric lining material 22 extends in between the road 12 and the roadbed 20 in a well-known manner. One or more temperature sensors 24 are positioned in the road 12 for outputting signals indicative of the temperature of the road 12 so that the temperature of the road 12 can be determined. Only one sensor 24 is depicted in FIG. 1 for purposes of clarity. However, it should be understood that more than one sensor 24 may be selectively disposed in the road 12 if desired to give indications of the temperature of various different portions of the road 12.

The road 12, the roadbed 20 and the fabric lining material 22 can be any road, roadbed and fabric lining material 22 used in the construction of roads. The making and using of the road 12, roadbed 20 and fabric lining material 22 are well known in the art and a discussion of same is not deemed to be necessary herein to teach one of ordinary skill in the art how to make and use the present invention.

The structure 10 includes two footings 30 which are designated in FIG. 1 by the general reference number 30*a* and 30*b* for purposes of clarity. The footings 30 underlie the road 12 with each footing 30 being securely mounted to the earth. The footings 30 extend in the direction 18, which is transverse to the road axis 14. The footings 30 are spaced apart in a direction substantially parallel to the road axis 14.

Each footing 30 includes a plurality of steel piers 32 which are driven into the earth in a well-known manner. A footing 34 of each footing 30 is supported by the piers 32. The footing 34 can be constructed of steel reinforced concrete for example or any other material which is securely connectable to the earth for providing a solid foundation upon which to support the remainder of the structure 10.

The structure 10 includes a support assembly 40 supported by the footings 30. The support assembly 40 extends at least the width of the road 12 and traverses the underpass space 16 for supporting the road 12 across the underpass space 16 spanned by the structure 10. As will be discussed below, the support assembly 40 is constructed to reduce the expansion and contraction of the structure 10 due to changes in temperature and weather, while also reducing the occurrence of premature icing of the road 12 extending across the structure 10.

The Applicants' unique support assembly 40 includes a substantially continuous inner shell 42 having a width at least corresponding to the width of the road 12. The inner shell 42 extends between the two footings 30 so as to define the underpass space 16 spanned by the structure 10. The inner shell 42 can be constructed of any suitable rigid, resilient material such as a plywood material covered with concrete, or a steel sheeting material covered with an epoxy coating, for example.

The support assembly 40 also includes a plurality of rigid, resilient beams 44, an insulating material 46, (FIG. 2) an outer shell 48, and a pair of sidewalls 50.

The beams 44 surmount the inner shell 42. Each beam 44 has a first end 54 supported by the footing 30*a* and a second end 56 supported by the footing 30*b*. The beams 44 are spatially disposed in the direction 18 which is transverse to the road axis 14 and have a longitudinal axis extending in a direction substantially parallel to the road axis 14. Each of the beams 44 can be prefabricated, arcuately shaped, rolled steel I-beams obtainable from any suitable source of steel and can have any size so long as the beams 44 cooperate to adequately support the structure 10. The beams 44 can be spaced apart any suitable distance there between, such as four foot centers, so that the beams 44 can adequately help to support the remainder of the structure 10 and the vehicles moving across the structure 10. In one preferred embodiment, the beams 44 are S4"×7.7 lbs. curved beams.

The insulating material 46 is positioned between each of the beams 44 for thermally isolating the road 12 from the underpass space 16 and substantially preventing the transfer of heat there through. In one embodiment, the insulating material 46 can be a substantially rigid insulating material such as Dowboard. The insulating material 46 can also be a blown-in insulating material, as discussed hereinafter.

The outer shell 48 has a first end 58 supported by the footing 30*a*, and a second end 60, supported by the footing 30*b*. The outer shell 48 substantially encases the beams 44 and the insulating material 46. The outer shell 48 can be constructed of a durable material, such as four to 12 inches of steel reinforced concrete. The thickness of the outer shell 48 can vary widely and will depend on the ultimate size of the structure 10, and the weight supported by the support assembly 40. Moreover, in one preferred embodiment where the outer shell 48 is formed on a 25 foot inner radius, the outer shell 48 has a thickness of about twelve inches adjacent to the footings 30 and tapers downwardly to a thickness of about six inches at a height of about four feet above the footings 30. In the last example, the remainder of the outer shell 48 (beyond about four feet above the footings 30) has a constant thickness of about six inches.

Figure 2:
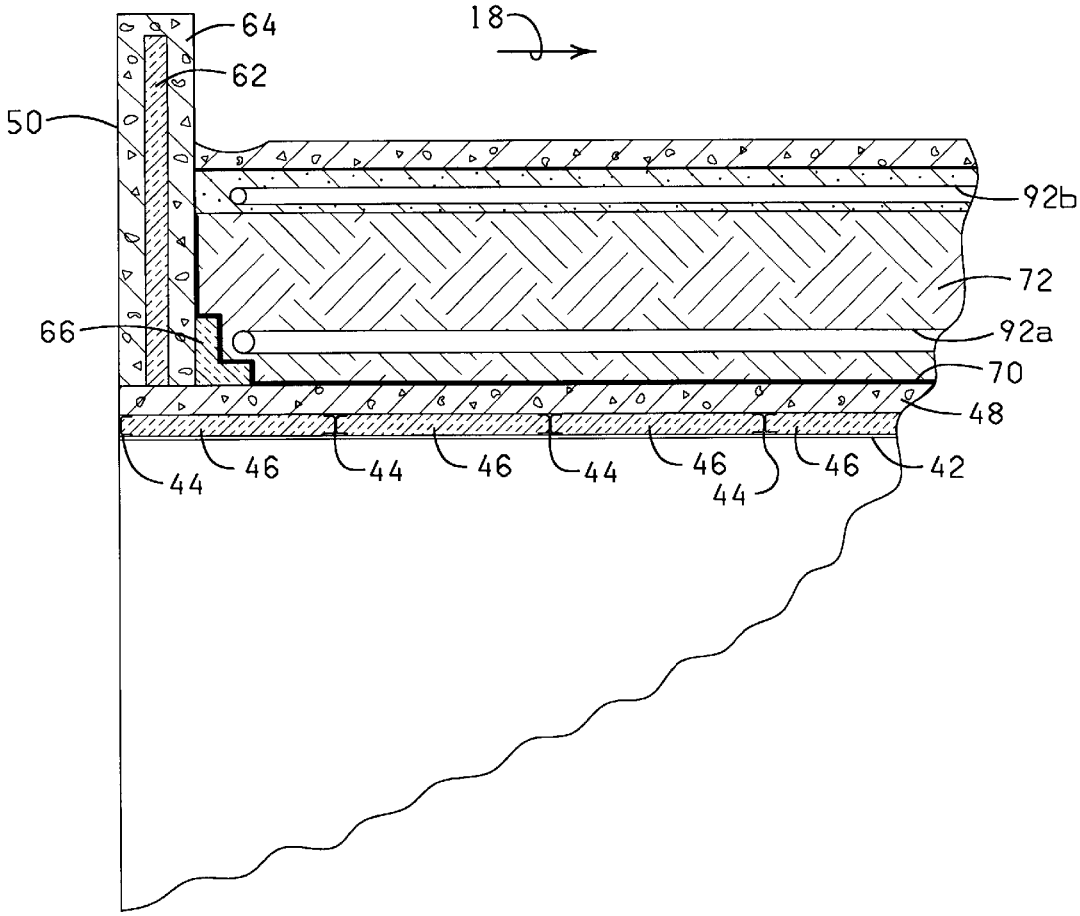
FIG. 2 is a fragmental, cross sectional view of the structure depicted in FIG. 1, taken along the lines 2—2.

Referring now to FIG. 2, shown therein is a cross-sectional, fragmental view of one half of the structure 10, taken along the lines 2—2 in FIG. 1. The structure 10 is generally symmetrical in construction, thus, it is not deemed necessary to show the other side of the structure 10.

One of the sidewalls 50 is shown in FIG. 2. The sidewalls 50 are identical in construction and function and therefore, only one will be described herein for purposes of clarity. The sidewall 50 extends upwardly from the outer shell 48 of the support assembly 40 to a position generally above the road 12. The sidewall 50 includes an inner insulating layer 62 which is encased inside an outer resilient casing 64. The inner insulating layer 62 can be a preselected amount of an insulating material so as to retard the flow of heat through the sidewall 50. In one embodiment, the inner insulating layer 62 can be constructed from approximately two inches to approximately four inches of a rigid insulating material such as Dowboard. The outer casing 64 can be constructed of any resilient, durable material such as steel reinforced concrete.

An insulating material 66 is provided at the junction of the sidewalls 50 and the outer shell 48. As best shown in FIG. 2, the insulating material 66 has an L-shaped cross-section such that the insulating material 66 extends along the sidewall 50, and outer shell 48 to stop the ingress and the egress of heat through the junction of the sidewalls 50 and the outer shell 48.

A substantially fluid impermeable material 70 substantially encases the arcuate support assembly 40, the insulating material 66 and the interior of the sidewalls 50. A fill material 72 extends from the substantially fluid impermeable material 70 to support the road 12. The substantially fluid impermeable material 70 can be a delta drain brand geo composite for foundation protection obtainable through Cosella Dorken of Beamsville, Ontario Canada. The fluid impermeable material 70 can also be a rubber polymer waterproofing membrane such as Wall-Guard brand obtainable from Valguard corporation of Oak Creek, Wis. The fill material 72 can be any suitable material, such as dried dirt, sand, aggregate, rock, or any combination thereof. The fill material 72 serves to store heat, and insulate the support assembly 40 from the elements, so that the support assembly 40 is maintained at a substantially constant temperature during fluctuations of the weather. In addition, the insulating material 46, inner insulating layer 62, and the insulating material 66 cooperate with the fill material 72 to help maintain the support assembly 40 at a substantially constant temperature which will typically be the average yearly temperature in the geographic location where the structure 10 is located.

A road 74 may be provided through the underpass space 16 defined by the structure 10. The road 74 is supported on a roadbed 76, and may be divided into two lanes 78 divided by a median 80. A pair of culverts 82 may be provided on respective sides of the road 74 for draining water away from the road 74.

In the colder geographic regions where there are extended periods of below freezing weather, the structure 10 may also include a temperature control assembly 90 for selectively regulating the temperature of the fill material 72 to preferably, about the yearly annual temperature for the geographic location where the structure 10 is located to stabilize the temperature of the structure, and therefore prevent the expansion and contraction of the support assembly 40 due to external weather conditions. The yearly annual temperature is typically in a predetermined range of between approximately 50 to 70 degrees Fahrenheit so as to retard the icing over of the road 12 disposed on the structure 10. The temperature control assembly 90 includes a heat exchange assembly 92 which is spatially disposed throughout the fill material 72, the roadbed 20, the roadbed 76, the median 80 and the culverts 82 so as to maintain the temperature of the fill material 72, the roadbed 20, the median 80 and the culverts 82 within the predetermined range. The heat exchange assembly which extends through the fill material 72 will be referred to hereinafter by the general reference numeral 92*a*. The heat exchange assembly which extends through the roadbed 20 will be referred to hereinafter by the general reference numeral 92*b*. The heat exchange assembly which extends through or underneath the roadbed 76, the median 80, and/or the culverts 82 will be referred to hereinafter by the general reference numeral 92*c*. The heat exchange assemblies 92*a*, 92*b* and 92*c* may be referred to herein collectively as the heat exchange assembly 92.

The temperature control assembly 90 includes a temperature control source 94. The temperature control source 94 communicates with the heat exchange assemblies 92*a*, 92*b* and 92*c* so as to selectively distribute or remove heat throughout the heat exchange assemblies 92*a*, 92*b* and 92*c* whereby heat is conductively introduced into or removed from the fill material 72, the roadbed 20, the roadbed 76, the median 80, and/or the culverts 82.

The temperature control source 94 and the heat exchange assembly 92 can be any suitable temperature control source and heat exchange assembly for emitting energy into or removing energy from the fill material 72, the roadbed 20, the roadbed 76, the median 80, and/or the culverts 82 and thereby controlling the temperature of the same. For example, the heat exchange assembly 92 can be a unitary conduit which is spatially disposed throughout the fill material 72, the roadbed 20, the roadbed 76, the median 80, and/or the culverts 82 in a serpentine pattern, or a plurality of conduits spatially disposed throughout the fill material 72, the roadbed 20, the roadbed 76, the median 80, and/or the culverts 82. In this embodiment, the temperature control source 94 would be adapted to recycle a heated or cooled fluid through the conduits of the heat exchange assembly 92 to thereby heat or cool the fill material 72, the roadbed 20, the roadbed 76, the median 80, and/or the culverts 82. The temperature control source 94 may be a water source heat pump.

Figure 3:
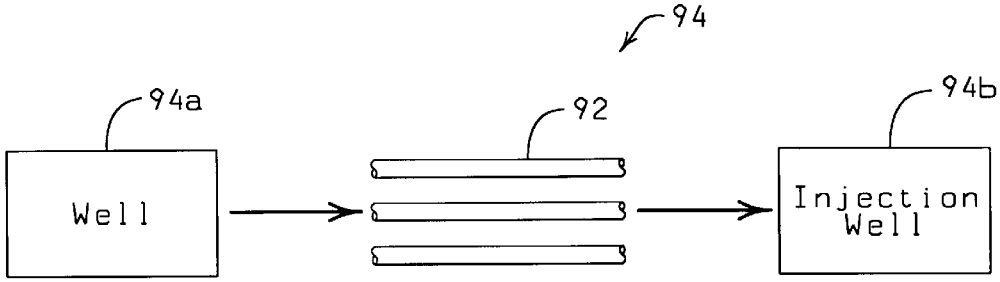
FIG. 3 is a diagrammatic, schematic view of a temperature control source supplying heat to a heat exchange assembly disposed throughout the fill material, in accordance with the present invention.

Referring now to FIG. 3, in one embodiment, the temperature control source 94 includes a well 94*a*, and an injection well 94*b*. The well 94 pumps fluid, such as water, out of the earth and through the conduits of the heat exchange assemblies 92*a*, 92*b* and 92*c*. After the fluid has passed through the heat exchange assemblies 92*a*, 92*b* and 92*c*, the fluid is moved into the injection well 94*b* where the fluid is inserted into the earth. The temperature control source 94 may also be adapted to heat the fluid coming out of the earth, or may include a heated tank of fluid for circulating through the conduits of the heat exchange assembly 92. In addition, the temperature control source 94 may also be adapted to circulate the fluid through the earth for heating or cooling the fluid.

The heat exchange assembly 92 can also be a plurality of electrical elements which are operably connected to the temperature control source 94, which in this case would be an electrical power source. The temperature control source 94 may be supplied with power from a solar energy source, or a windmill, or any other suitable source of electricity.

The temperature control source 94 communicates with the heat exchange assembly 92*a* via a fill material control valve 96 and a heat exchange line 98. The temperature control source 94 communicates with the heat exchange assembly 92*b* via a roadbed control valve 100 and a heat exchange line 102. The temperature control source 94 communicates with the heat exchange assembly 92*c* via a underpass road control valve 104 and a heat exchange line 106.

Figure 4:
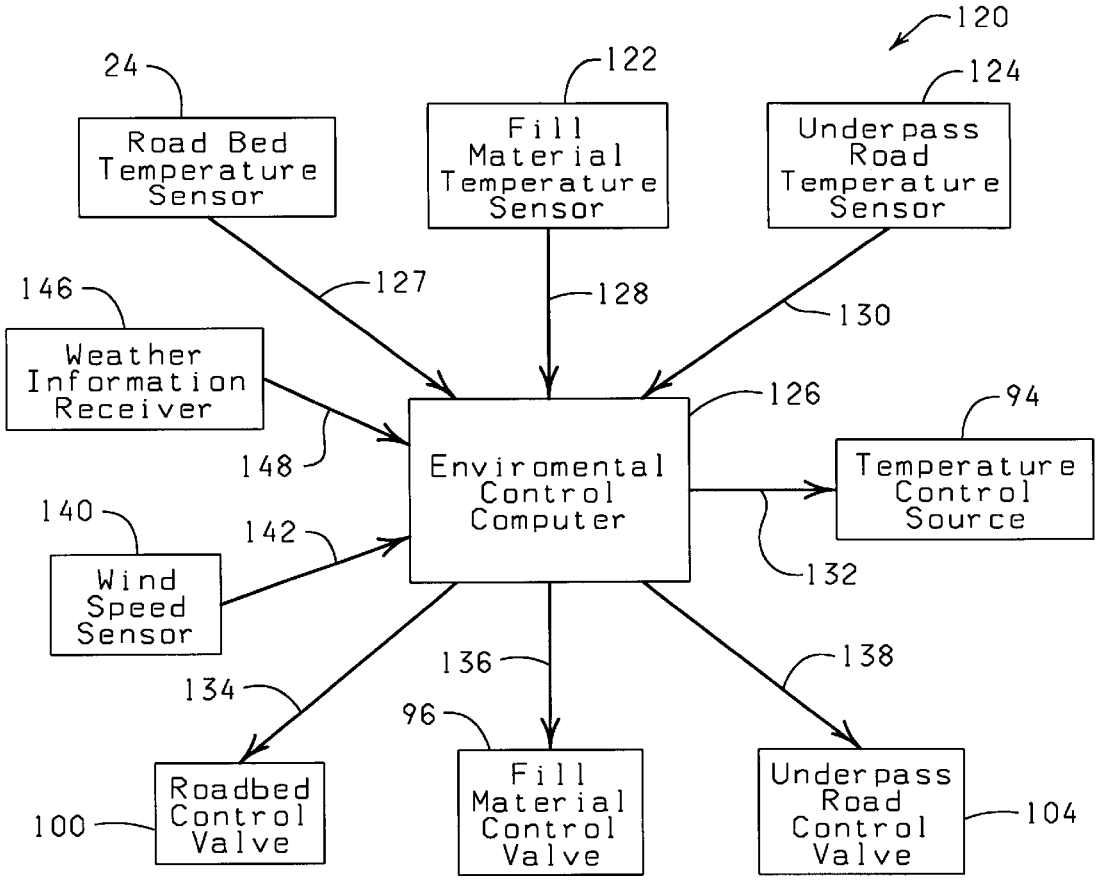
FIG. 4 is a diagrammatic, schematic view of an environmental control computer constructed in accordance with the present invention.

Referring now to FIG. 4, shown therein is a computerized control system 120 which functions to control the temperature control source 94 and the fill material control valve 96, the roadbed control valve 100, and the underpass road control valve 104 in a manner so as to maintain the temperature of various portions of the structure 10 at a predetermined temperature, such as the annual average temperature of the geographic location where the structure 10 is located.

The control system 120 includes the roadbed temperature sensor 24, one or more fill material temperature sensors 122, and one or more underpass road temperature sensors 124. The roadbed temperature sensors 24, the fill material temperature sensors 122, and the underpass road temperature sensors 124 can be spatially disposed throughout the respective road 12, fill material 72, and the road 74, the roadbed 76, the median 80, and the culverts 82. The roadbed temperature sensors 24, the fill material temperature sensors 122, and the underpass road temperature sensors 124 generate signals indicative of the temperature of the respective road 12, fill material 72 and the road 74, the roadbed 76, the median 80, and/or the culverts 82.

The control system 120 includes an environmental control computer 126. The environmental control computer 126 receives the signals indicative of the temperature from the roadbed temperature sensor 24, the fill material temperature sensor 122, and the underpass road temperature sensor 124 via respective signal paths 127, 128 and 130. Stored in the environmental control computer 126 are pre-programmed temperature settings for maintaining each of the respective road 12, fill material 72, road 74, roadbed 76, median 80, and/or culverts 82 at the pre-programmed temperature. Based on the signals received from the sensors 24, 122 and 124, the environmental control computer 126 output signals to the temperature control source 94 via a signal path 132, and signals to the roadbed control valve 100, fill material control valve 96, and underpass road control valve 104 via respective signal paths 134, 136, and 138 to selectively control the temperature of the roadbed 20, fill material 72, roadbed 76, median 80, and/or culverts 82 and to maintain such temperatures at the pre-programmed temperatures.

The computerized control system 120 may also be provided with a wind sensor 140 located near the structure 10. The wind sensor 140 output signals indicative of the wind speed via a signal path 142 to be received by the environmental control computer 126. The environmental control computer 126 receives these signals output by the wind sensor 140 and, in response thereto, adjusts the signals sent to the temperature control source 94, and/or the roadbed control valve 100, fill material control valve 96, and/or underpass road control valve 104 to take into account the wind chill factor when determining whether to supply heat to the roadbed 20, fill material 72, roadbed 76, median 80 and/or culverts 82. Based on decreasing temperature readings or an increasing or large wind chill factor, the environmental control computer 126 in one preferred embodiment outputs signals to the temperature control source 94 and the valves 100 and 104 to heat the roads 12 and 74, for example.

The computerized control system 120 also includes a weather information receiver 146 which is adapted to receive information regarding local weather forecasts from any suitable source, such as the national weather service. After the weather information receiver 146 receives the information regarding the weather forecast, the weather information receiver 146 transmits such information to the environmental control computer 126 via a signal path 148. Upon receiving the information from the weather information receiver 146, the environmental control computer 126 may output signals to the temperature control source 94, the roadbed control valve 100, the fill material control valve 96, and/or the underpass road control about 104 so that the structure 10 is prepared for any adverse weather conditions. For example, if the signal received from the weather information receiver 146 indicates that the structure 10 will soon be subjected to an ice storm, the environmental control computer 126 may output signals to the temperature control source 94 and the roadbed control valve 100 to begin pre-heating the roadbed 20, and thus the road 12, to prevent the road 12 from icing over.

It should be noted that the signal paths 127, 128, 130, 132, 134, 136, 138, 142 and 148 can either be airway or cable communication links. The environment control computer 126 may be disposed a significant distance away from the remainder of the control system 120 so as to operate remotely from the remainder of the control system 120 and thereby remotely control the operation of the structure 10.

The structure 10 may be built as follows; initially, the building site to contain the structure 10 is excavated. Then, the piers 32 of the footing 30 are driven into the earth via a hydraulic assembly, for example. Once the piers 32 are in place, the footing 34 is constructed by using steel reinforced concrete poured into forms, for example.

Once the footings 30 are constructed, the beams 34 are positioned onto the footings 30 and then anchored to the footings 34, thereof, via any suitable means, such as bolts, for example.

Thereafter, the material forming the inner shell 42 is attached to the beams 44 via any suitable method, such as bolts and the inner shell 42 is coated via any suitable material, such as spray concrete or spray epoxy, to protect the inner shell 42. Once the inner shell 42 is secured in place on the beams 44, the insulating material 46 is added between the beams 44. The insulating material 46 can be rigid pieces of insulating material, such as two inch thick styrofoam, Dowboard or the like, or a blown in or sprayed on insulating material to at least partially fill the cavities between the beams 44. In one preferred embodiment, the insulating material 46 only fills about ¼ to ½ of the space between the beams 44 and the other ¾ to ½ of the space between the beams 44 is later filled with concrete. Depending on the particular geographic location where the structure 10 is located, the thickness of the beams 44 and insulating material 46 can be varied so as to effectively insulate the remainder of the support assembly 40 to substantially prevent the support assembly 40 from expanding and contracting based on weather conditions. Once the insulating material 46 has cured, durable reinforcing members (not shown), such as one grid-like layer, or more than one spaced grid-like layers of a durable material, such as two spatially disposed steel grids with each grid being formed of #4 steel bars and the #4 steel bars being positioned on 12 inch centers, are positioned over the beams 44 for constructing the outer shell 48.

Once the reinforcing members, such as steel, for forming the outer shell 48 are positioned over the beams 44, a resilient, durable material, such as concrete, is disposed about the reinforcing members so as to form the outer shell 48. Depending on the size of the structure 10, the outer shell 48 should be between four to six inches. Thus, it can be seen that the insulating material 46, and the beams 44 define a form to permit the resilient, durable material to be disposed about the reinforcing members.

Thereafter, the inner insulating layers 62 of the sidewalls 50 are positioned near the ends of the outer shell 48, substantially shown in FIG. 2. A waterproofing membrane, such as Wal-Guard, discussed above, is then sprayed over the inner insulating layers 62 to protect the inner insulating layers 62 from the intrusion of water. Thereafter, rigid, reinforcing members, such as #4 steel bars positioned in a grid-like pattern on 12 inch centers, are disposed around the inner insulating layer 62, and a resilient, durable material, such as concrete is positioned about the reinforcing members to form the sidewall 50. Once the resilient, and durable material has cured, the insulating material 66 is positioned adjacent to the interior of the sidewall 50, and on the outer shell 48.

Then, the fluid impermeable material 70 is positioned about the outer shell 48 and the insulating material 66, and thereafter, the fill material is backfilled and compacted symmetrically on both sides over the fluid impermeable material 70 utilizing a technique known in the art as "soil arching". Various compaction methods can be utilized when disposing the fill material 72 about the support assembly 40. The thickness of the fill material 72 can be varied based on the particular geographic location where the structure 10 is to be installed. For example, if the structure 10 is to be installed in a cooler location, such as North Dakota, the thickness of the fill material 72 can be increased so that the fill material 72 will store more energy to help reduce or prevent the occurrence of the road 12 supported by the fill material 72 from icing over. Likewise, in warmer climates (such as Georgia), it may be desirable to reduce the thickness of the fill material 72 to reduce the cost of the structure 10. In one preferred embodiment, after compaction the fill material 72 has a thickness extending over the apex of the support assembly 40 of at least about 1 foot.

If it is desired to utilize the temperature control assembly 90, the heat exchange assembly 92*a* can be positioned on a portion of the fill material 72, and then more fill material 72 can be added so that the heat exchange assembly 92 is spatially disposed throughout the fill material 72. When the fill material 72 is being added above the heat exchange assembly 92, and the heat exchange assembly 92 are conduits, the conduits can be pressurized so that the conduits will not collapse during compaction. The 91 fill material temperature sensor 122 is positioned in the fill material 72 while the fill material 72 is being added.

Finally, when addition of the fill material 72 is complete, the road 12, roadbed 20 and fabric lining material 22 are added. If the heat exchange assembly 92*b* is desired, a portion of the roadbed 20 is poured, and the heat exchange assembly 92*b* is positioned on top of the poured portion of the roadbed 20. Once the heat exchange assembly 92*b* is positioned on top of the poured portion of the roadbed 20, the remainder of the roadbed 20 is added and the heat exchange assembly 92*b* is simultaneously pressurized to prevent same from collapsing. The fabric lining material 22 and the road 12 are then positioned on top of the roadbed 20. The roadbed temperature sensor 24 can be positioned in the road 12 while the road 12 is being constructed.

The heat exchange assembly 92*c* if desired, is then positioned underneath the structure 10. If the heat exchange assembly 92*c* includes conduits, the conduits are pressurized and the roadbed 76, road 74, median 80 and culverts 82 are positioned on top of the heat exchange assembly 92*c*. The underpass road temperature sensors 124 can be added to the roadbed 76, road 74, median 80, and/or culverts 82 as desired, during the construction of the roadbed 76, road 74, median 80, and/or culverts 82.

It will be appreciated that many changes and/or modifications can be made to Applicants' unique structure 10 to change or enhance the functionality of the structure 10. For example, more valves and temperature sensors can be added to the control system 120 so that the temperature of various locations on the road 12, support assembly 40, or road 74 could be monitored and compensated for via the temperature control source 94 and the environmental control computer 126. In addition, heated culverts can be added to the road 12 for safely draining away any ice or water collecting on the road 12 of the structure 10.

Furthermore, it will be appreciated that Applicants' unique structure 10 includes a thin shell structure which provides an isolated and insulated thermal mass for the structure 10 to maintain a year-round constant temperature for the support assembly 40 and to help prevent the icing over of the road 12. Moreover, the reduction in the expansion and contraction of the structure 10 increases the lifespan of the structure 10 and reduces the amount of material which must be utilized in constructing the structure 10. Finally, the dangers of the structure 10 icing over in cold weather is substantially reduced.

Figure 5:
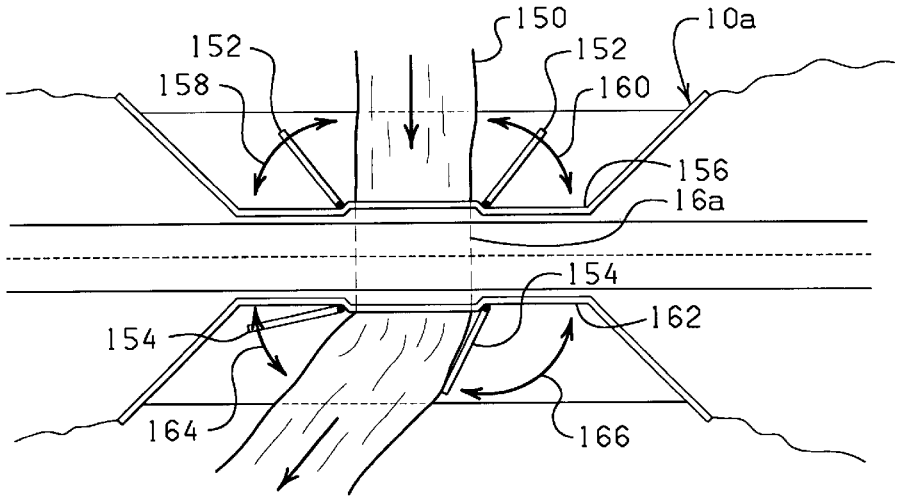
FIG. 5 is a top plan view of a second embodiment of a structure constructed in accordance with the present invention.

Referring now to FIG. 5, shown therein and designated by the reference numeral 10*a* is a second embodiment of a structure, constructed in accordance with the present invention. The structure 10*a* is constructed in an identical manner as the structure 10, discussed herein with reference to FIGS. 1–4, except as discussed hereafter. The structure 10*a* is positioned adjacent to a river 150 such that the river 150 flows through an underpass space 16*a*. It should be understood that the term "river", as used herein, can refer to any waterway capable of passing through the underpass space 16*a*, such as a river or creek.

The structure 10*a* includes a pair of inlet barriers 152, and a pair of outlet barriers 154. The inlet barriers 152 are pivotally connected to an inlet side 156 of the structure 10*a*, generally on either side of the river 150. The inlet barriers 152 are selectively pivotable, as indicated by the arrows 158 and 160 so as to control or direct the movement of the water in the river 150 into the underpass space 16*a*.

The outlet barriers 154 are pivotally connected to an outlet side 162 of the structure 10*a*, generally on either side of the river 150. The outlet barriers 154 are selectively pivotable as indicated by the arrows 164 and 166 so as to direct or control the direction of flow of the water in the river 150 as it exits from the underpass space 16*a*.

The inlet barriers 152, and outlet barriers 154 can be constructed of any suitable material, such as steel, or steel reinforced concrete. In addition, the inlet barriers 152, and the outlet barriers 154 can be pivotally connected to the respective inlet side 156, and the outlet side 162, of the structure 10*a* by any suitable mechanical assembly, such as hinges. The movement of the inlet barriers 152 and outlet barriers 154, as indicated by the arrows 158, 160, 164 and 166 can be accomplished by any suitable assembly, such as a mechanical assembly. For example, hydraulic cylinders (not shown) can be utilized to selectively move the inlet barriers 152 and the outlet barriers 154. The assemblies utilized for moving the inlet barriers 152 and the outlet barriers 154 can be remotely or locally controlled by the environmental control computer 122.

Figure 6:
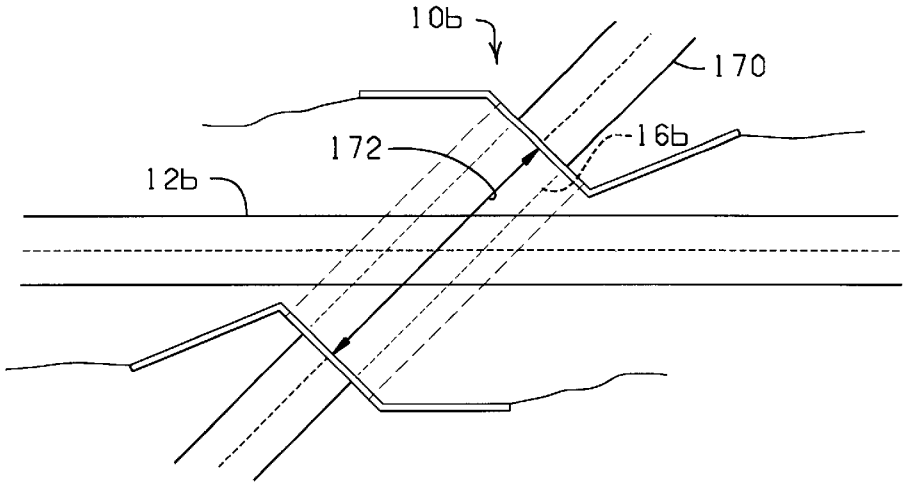
FIG. 6 is a top plan view of a third embodiment of a structure constructed in accordance with the present invention.

Referring now to FIG. 6, shown therein and designated by the reference numeral 10*b* is another embodiment of a structure, which is constructed in accordance with the present invention. The structure 10*b* is constructed in an identical manner as the structures 10 and 10*a* (which were described hereinbefore with reference to FIGS. 1–5) except as discussed hereinafter.

The structure 10*b* supports a road 12*b* over an underpass space 16*b*. A road 170 passes through the underpass space 16*b*. The structure 10*b* includes a width 172. The angle between the road 12*b*, supported by the structure 10*b*, and the road 170 passing through the underpass space 16*b* can be varied upon constructing the structure 10*b*, simply by adjusting the width 172 and the orientation of the structure 10*b* so that there is an adequate area supported by the structure 10*b* to fully support the road 12*b*.

Figure 7:
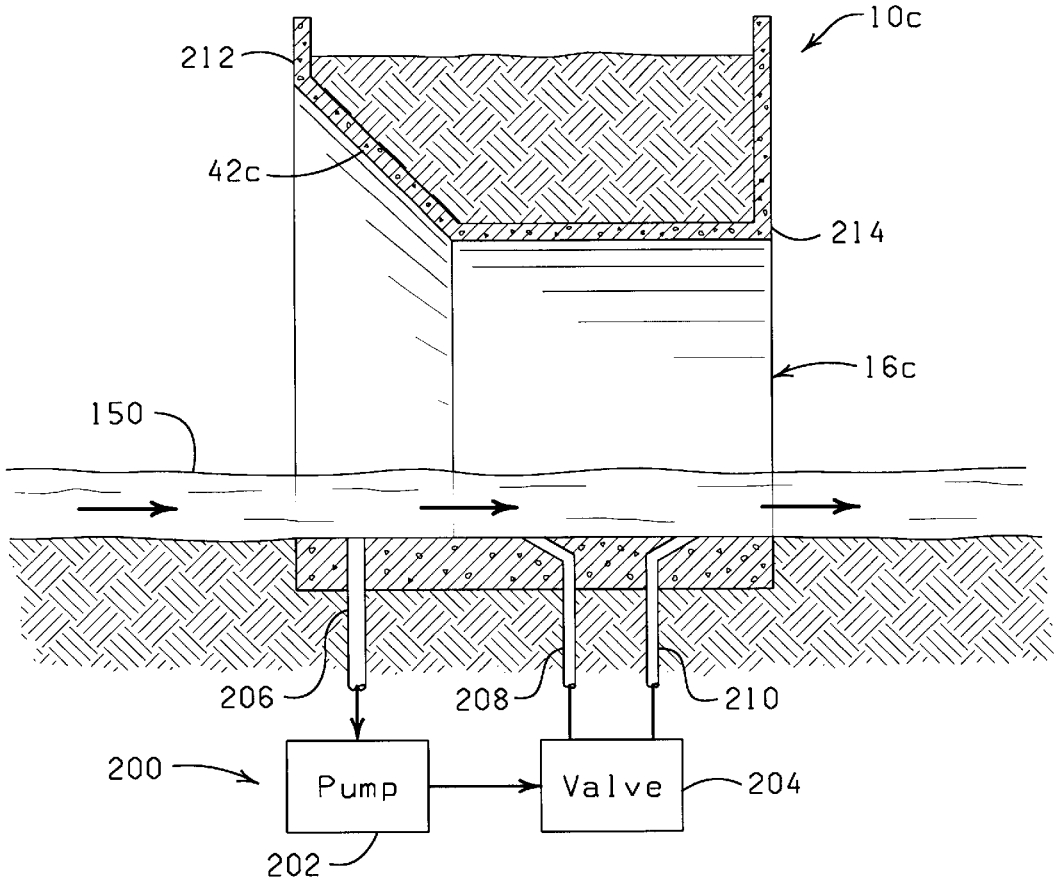
FIG. 7 is a sectional view of a fourth embodiment of a structure constructed in accordance with the present invention.
Figure 5:
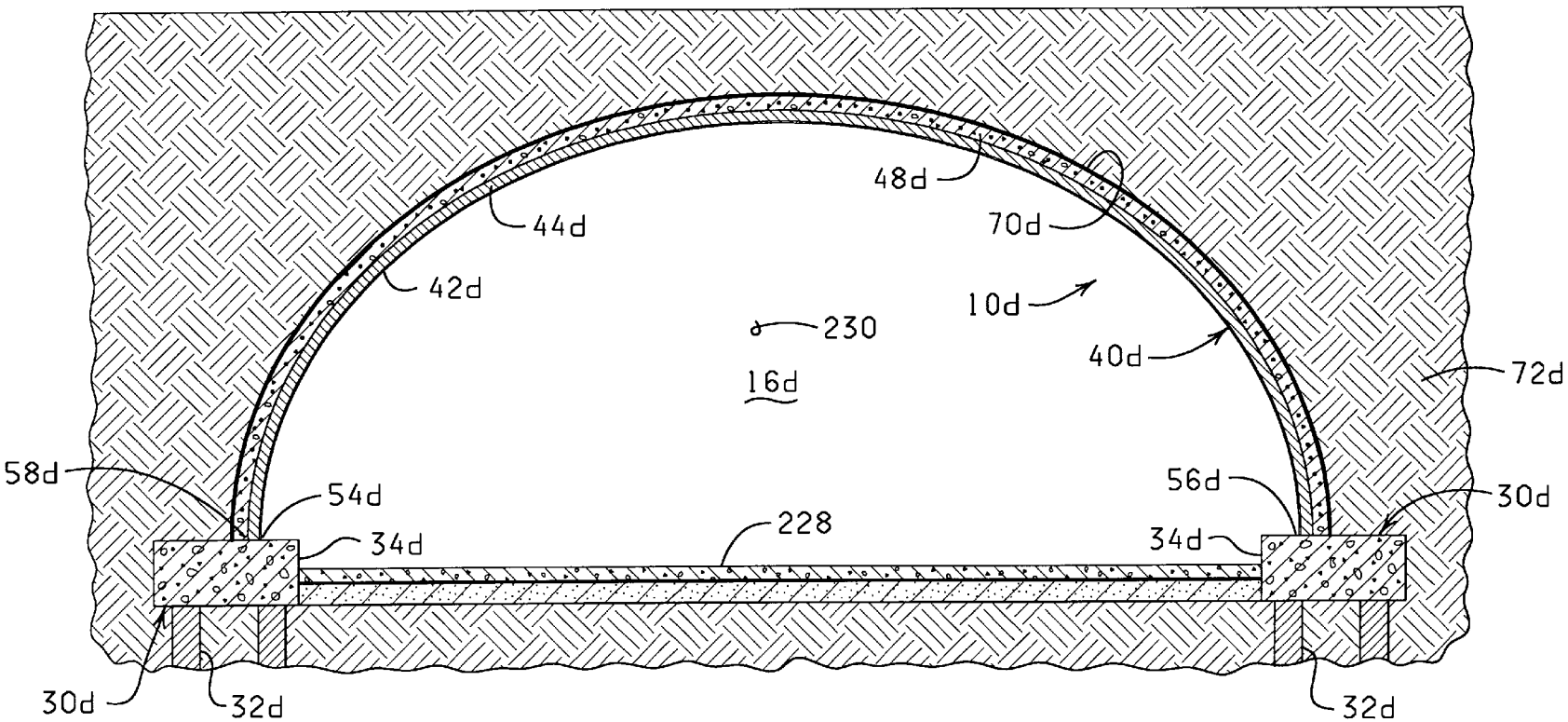

Referring now to FIG. 7, shown therein and designated by the general reference numeral 10*c*, is another embodiment of a structure, which is constructed in accordance with the present invention. The structure 10*c* is constructed in a similar manner as the structure 10*a*, except as discussed below. The structure 10*c* includes a flow control assembly 200 for controlling the rate of flow of the river 150 passing through an underpass space 16*c* thereof. The flow control assembly 200 includes a pump 202, and a valve 204. The pump 202 receives water from the river 150 through an inlet 206 communicating with the underpass space 16*c*. When actuated, the pump 202 draws water from the river 150 through the inlet 206, and ejects pressurized water through the valve 204 to control the rate of flow of the river 150. The environmental control computer 122 can be utilized to selectively actuate the pump 202.

The valve 204 can be selectively actuated by the environmental control computer 122 to direct the water provided by the pump 202 to either enhance or reduce the flow of the river 150 through the underpass space 16*c*. That is, the valve 204 communicates with a first outlet 208, and a second outlet 210. The first outlet 208 is positioned to direct the pressurized water passing through the valve 204 in a direction generally against the flow of the river 150. The second outlet 210 is positioned to direct the water passing through the valve 204 in a direction generally with the flow of the river 150.

When the valve 204 is actuated such that the water received by the valve 204 is directed to the first outlet 208, force is applied to the river 150 to decrease the flow of the river 150 through the underpass space 16*c*. When the valve 204 is actuated such that the water received by the valve 204 is directed to the second outlet 210, force is applied to the river 150 to increase the flow of the river 150 through the underpass space 16*c*.

Although the flow control assembly 200 has been described herein as the pump 202 in combination with the valve 204, the inlet 206, the first outlet 208 and the second outlet 210, it should be understood that the flow control assembly 200 could be any suitable assembly for accomplishing the purpose of controlling the rate of flow of the river 150. For example, the flow control assembly 200 could include a rotatable propeller (not shown) positioned in the underpass space 16*c*. The propeller could be powered by any suitable drive train, such as a motor or engine and associated transmission.

It should be noted that the flow control assembly 200 can be utilized in combination with the movable inlet barriers 152, and the outlet barriers 154 so that the direction and speed of the flow of the river 150 can be simultaneously controlled.

It should also be noted that an inner shell 42*c* of the structure 10*c* can be tapered from an inlet side 212 of the structure 10*c* towards an outlet side 214 of the structure 10*c* to reduce the cross-section of the underpass space 16*c* and thereby slow the rate of flow of the river 150 through the underpass space 16*c*.

Referring now to FIG. 8, shown therein and designated by the general reference numeral 10*d* is a fifth embodiment of a structure constructed in accordance with the present invention. The structure 10*d* is constructed in a similar manner as the structure 10, except as that the roads 74, median 80, and culverts 82 have been removed and replaced with a continuous bottom 228, extending in between the footings 30*d*. The continuous bottom 228 can be formed of steel reinforced concrete, or in one preferred embodiment is constructed in an identical manner as the support assembly 40. For purposes of clarity, elements in common between the structures 10 and 10*d* will not be described hereinafter, but are labeled in FIG. 8 with the same numeral prefix followed by the alphabetic suffix "d".

In general, the structure 10*d* forms a culvert or a pipeline positioned below a fill material 72*d*, such as the earth. The structure 10*d* defines a bore 229, which can be utilized for transporting fluids, such as water or waste. The structure 10*d* forming the culvert has a longitudinal axis 230 (shown as extending into the page) of any predetermined length. For example, the longitudinal axis 230 can have a length of 100 feet, one mile, four miles or 100 miles. The entire structure 10*d* extends along the longitudinal axis 230. For example, if the longitudinal axis 230 of the structure 10*d* has a length of one mile, then each of the footings 30*d* have a length of one mile, the bore 229 has a length of one mile, and the continuous bottom 228 has a length of one mile, for example.

The structure 10*d* is constructed in a similar manner as the structure 10, which was described hereinbefore with reference to FIGS. 1 and 2, except that the continuous bottom 228 is formed in between the footings 30*d* rather than the roads 74, median 80, and culverts 82.

In one preferred embodiment, the continuous bottom 228 has an arcuate cross-sectional shape so that the bore 229 is provided with a cylindrical shape. A liner (not shown), such as stainless steel, plastic or glass can be sprayed on or otherwise secured to the interior of the structure 10*d* to accommodate a variety of different fluids to be transported. In this last embodiment, the liner would surround and define the bore 229. The particular type of liner would be selected based on the type of fluid that the structure 10*d* would be utilized to transport.

Changes may be made in the embodiments depicted and described herein, or in the elements, steps and/or sequence of steps of the methods described herein without departing from the spirit and the scope of the invention as defined in the following claims.

What is claimed is:

1. A structure for supporting a road along a road axis over an underpass space spanned by the structure, the road having a predetermined width extending in the direction transverse to the road axis, comprising:

two footings underlying the road with each footing being securely mounted to the earth, each footing being spaced apart in a direction substantially parallel to the road axis;

a support assembly supported by the footings, the support assembly having an arcuate shape and extending at least the width of the road and traversing the underpass space for supporting the road across the underpass space spanned by the structure, the support assembly comprising:

a substantially continuous inner shell having a width at least corresponding to the width of the road, and extending between the two footings so as to define the underpass space spanned by the structure;

a plurality of rigid, beams surmounting the inner shell, each beam having a first end supported by one of the footings, and a second end supported by the other footing, the beams being spatially disposed in a direction transverse to the road axis and having a longitudinal axis extending in a direction substantially parallel to the road axis, the beams being substantially parallel to each other;

an insulating material being positioned between each of the beams for thermally isolating the road and the support assembly from the underpass space and substantially preventing the transfer of heat therethrough;

an outer shell having a first end supported by one of the footings, and a second end supported by the other footing, the outer shell being positioned above the beams and the insulating material;

a substantially fluid impermeable material substantially encasing the support assembly; and a fill material extending from the substantially fluid impermeable material to support the road whereby the fill material is insulated and stores heat to substantially prevent the inadvertent icing over of the road.

2. A structure as defined in claim 1, wherein the support assembly also comprises a pair of sidewalls extending parallel to the road axis on either side of the support assembly, the sidewalls being provided with an inner insulating layer to prevent heat from migrating through the sidewalls, and an outer resilient casing encasing the inner insulating layer.

3. A structure as defined in claim 2, further comprising two separate insulating materials with each insulating material positioned adjacent to the junction of one of the sidewalls and the outer shell.

4. A structure as defined in claim 1, further comprising a heat exchange assembly disposed throughout the fill material to maintain the temperature of the fill material within a predetermined range so as to reduce the possibility of the road supported by the structure from icing over, and a temperature control source connected to the heat exchange assembly for providing a heat exchange medium to the heat exchange assembly for controlling the temperature of the fill material.

5. A structure as defined in claim 4, wherein the heat exchange assembly includes at least one conduit, and the temperature control source includes a well, and an injection well, the well pumping a fluid out of the earth and through the conduit of the heat exchange assembly such that after the fluid has passed through the heat exchange assembly, the fluid is moved into the injection well where the fluid is inserted into the earth.

6. A structure as defined in claim 4, further comprising:

a weather information receiver capable of receiving information regarding weather forecasts from a suitable source of information and of transmitting such information;

an environmental control computer receiving the information regarding weather forecasts from the weather information receiver and for selectively actuating or deactuating the temperature control source based on the information received from the weather information receiver.

7. A structure as defined in claim 1, further comprising:

a heat exchange assembly disposed underneath or through at least one of the road supported by the structure, the road passing through the underpass space defined by the structure, and the fill material;

a temperature control source capable of providing a heat exchange medium to the heat exchange assembly;

at least one temperature sensor located near the heat exchange assembly so as to provide signals indicative of the temperature near the exchange assembly;

an environmental control computer receiving the signals from the temperature sensor, the environmental control computer communicating with the temperature control source, and selectively outputting signals to the temperature control source based on the signals received by the environmental control computer from the temperature sensor so as to maintain the temperature near the heat exchange assembly at a predetermined temperature pre-programmed into the environmental control computer.

8. A structure as defined in claim 7, wherein the heat exchange assembly is disposed through or passes underneath at least two of the road supported by the structure, the road passing through the underpass space defined by the structure, and the fill material.

9. A structure as defined in claim 7, wherein the environmental control computer is disposed remotely from the structure.

10. A structure as defined in claim 7, further comprising:

a wind sensor located near the structure and adapted to output signals indicative of the wind speed near the structure; and wherein the environmental control computer receives the signals from the wind sensor and adjusts the signals output to the temperature control source based on the signals received from the wind sensor.

11. A method for building a structure for supporting a road along a road axis over an underpass space spanned by the structure, the method comprising the steps of:

positioning a plurality of beams on a pair of spatially disposed footings such that the beams are spatially disposed in a direction transverse to the road axis and traverse an underpass space in a direction substantially parallel to the road axis, the beams being substantially parallel to each other;

attaching an inner shell to the plurality of beams;

positioning an insulating material between the beams whereby the insulating material is disposed adjacent to the inner shell attached to the beams;

forming an outer shell over the beams and insulating material whereby the beams and insulating material define a part of a form utilized in creating the outer shell;

positioning a fluid impermeable material about the outer shell so as to provide a fluid impermeable barrier about the outer shell; and positioning a fill material on top of the fluid impermeable material.

12. A method as defined in claim 11, further comprising the step of constructing a road on top of the fill material whereby the road is supported by the structure.

13. A method as defined in claim 12, further comprising the step of constructing a road in the underpass space defined by the structure.

14. A method as defined in claim 13, further comprising the step of regulating the temperature of at least one of the road supported by the structure, the road passing through the underpass space, and the fill material.

15. A method as defined in claim 11, further comprising the steps of constructing a pair of sidewalls on either side of the outer shell such that the sidewalls extend upwardly from the outer shell; and positioning respective insulating materials at the junctions of the sidewalls and the outer shell to prevent the ingress and egress of heat through the junctions of the sidewalls and the outer shell.

16. A method as defined in claim 11, further comprising the steps of:

positioning a heat exchange assembly in the fill material; and connecting a temperature control source to the heat exchange assembly for selectively passing a heat exchange medium through the heat exchange assembly to regulate the temperature of the fill material.

17. A method as defined in claim 16, further comprising the steps of:

positioning a temperature sensor near the heat exchange assembly; and controlling the temperature control source based on signals received from the temperature sensor so as to maintain the fill material at a substantially constant predetermined temperature.

18. A method as defined in claim 17, further comprising the steps of:

positioning a wind speed sensor near the structure whereby the wind speed sensor is capable of outputting signals indicative of the wind speed near the structure; and regulating the temperature control source based on the signals output by the wind speed sensor.

19. A structure for supporting a road along a road axis over an underpass space spanned by the structure, comprising:

two footings underlying the road with each footing being securely mounted to the earth, each footing being spaced apart in a direction substantially parallel to the road axis;

a support assembly supported by the footings, the support assembly extending at least the width of the road and traversing the underpass space for supporting the road across the underpass space spanned by the structure, the support assembly comprising:

a plurality of rigid beams, each beam having a first and supported by one of the footings, and a second and supported by the other footing, the beams being spatially disposed in a direction transverse to the road axis and having a longitudinal axis extending in a direction substantially parallel to the road axis, the beams being substantially parallel to each other;

an insulating material positioned between the beams for thermally isolating the road and the support assembly from the underpass space and substantially preventing the transfer of heat there through; and an outer shell being positioned above the beams and the insulating material;

a pair of sidewalls extending parallel to the road axis on either side of the outer shell, the sidewalls being provided with an inner insulating layer to prevent heat from migrating through the sidewalls, and an outer resilient casing encasing the inner insulating layer;

respective insulating materials positioned at the junctions of the respective sidewalls and the outer shell;

a substantially fluid impermeable material substantially encasing the support assembly;

a fill material extending from the substantially fluid impermeable material to support the road whereby the fill material is insulated and stores heat to substantially prevent the inadvertent icing over of the road.

* * * * *